US006739382B2

(12) United States Patent
De Luca et al.

(10) Patent No.: US 6,739,382 B2
(45) Date of Patent: May 25, 2004

(54) DEVICE FOR LATERAL CONTAINMENT OF LIQUID STEEL BETWEEN CRYSTALLIZING ROLLS OF A CASTING MACHINE FOR A STEEL STRIP

(75) Inventors: Andrea De Luca, Remanzacco (IT); Nuredin Kapaj, Udine (IT); Alfredo Poloni, Fogliano Redipuglia (IT); Andrea Bonera, Palmanova (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 10/229,569

(22) Filed: Aug. 28, 2002

(65) Prior Publication Data

US 2003/0041997 A1 Mar. 6, 2003

(30) Foreign Application Priority Data

Aug. 29, 2001 (EP) ..... 01120627

(51) Int. Cl.[7] ..... B22D 11/06
(52) U.S. Cl. ..... 164/428; 164/480
(58) Field of Search ..... 164/428, 480

(56) References Cited

U.S. PATENT DOCUMENTS 5,400,849 A * 3/1995 Sasaki et al. ..... 164/416
5,584,335 A 12/1996 Barbe et al.
5,588,479 A * 12/1996 Leadbeatter et al. ..... 164/480
5,628,359 A * 5/1997 Legrand et al. ..... 164/428
5,638,892 A 6/1997 Barbe et al.
5,704,414 A * 1/1998 Breviere ..... 164/428
6,032,722 A * 3/2000 Russell et al. ..... 164/428
RE37,214 E * 6/2001 Barbe et al. ..... 164/428

FOREIGN PATENT DOCUMENTS

| | | |
|---|---|---|
| EP | 0 556 657 A1 | 8/1993 |
| GB | 2 296 883 A | 7/1996 |
| GB | 2 337 016 A | 11/1999 |

* cited by examiner

*Primary Examiner*—Kiley Stoner
*Assistant Examiner*—Kevin P. Kerns
(74) *Attorney, Agent, or Firm*—Jenkins, Wilson & Taylor, P.A.

(57) ABSTRACT

With a device for a lateral containment of liquid steel between two crystallizing rolls of a casting machine for a steel strip, comprising a refractory skid (4) and a thrust unit (37) for the skid (4). there are provided at least 3 spaced steel plates ($P_1, P_i, P_{i+1}, \ldots P_n$) successively arranged between the skid (4) and a thrust unit (37) and interconnected by means of fixing elements (12) in a staggered arrangement to optimize the contact conditions between the containing plates and the side faces of the corresponding rolls and to ensure excellent uniform pressure distribution on these plates in sliding contact with the rolls allowing the plates to adapt well to the reference surface of the rolls or working conditions. Each fixing element (12) that connects the plate ($P_i$) to next plate ($P_{i+1}$) has associated thereto at least one pair of fixing elements (12) connecting the next plate ($P_{i+1}$) to the following next plate ($P_{I+2}$).

31 Claims, 11 Drawing Sheets

Inner Plate

Outer plate

DEVICE FOR LATERAL CONTAINMENT OF LIQUID STEEL BETWEEN CRYSTALLIZING ROLLS OF A CASTING MACHINE FOR A STEEL STRIP

FIELD OF THE INVENTION

The invention refers to a device for lateral containment of liquid steel between the crystallizing rolls of a casting machine for a steel strip.

BACKGROUND OF THE INVENTION

Devices to contain the melted metal in the continuous casting machines for steel strip are already known.

Particularly well-known are the solutions that adopt oscillating connections, which allow the plates to self-align with the ends of the casting rolls.

More specifically, patent GB 2,296,883 considers the so-called pivoting elements positioned with respect to the action line of the pushing force produced by the liquid bath, so that the action of this force tends to make the plates rotate towards the lower part of the rolls.

With this solution the required alignment of the plates with respect to the rolls is obtained, but in some circumstances it can lead to operating difficulties. In fact, as the plates are free to rotate on their planes they expose different contact areas on the roll ends and, if the plates are already worn there may be wearing shoulders above the contact with the newly exposed faces, thus resulting in a poor closing contact, misalignment of the lateral barriers and losses of melted metal from the casting bath.

Patent GB 2,337,016 solves the above-mentioned rotation problem: in fact, thanks to the action of pins, the plate can freely oscillate both longitudinally and laterally to the rolls, but the rotation of the plate on its own plane is limited. But this solution does not allow uniform pressure distribution on the refractory surface, which is consequently subject to uneven wear; this wear is greater in certain areas and therefore the refractory needs to be replaced frequently.

In order to avoid these inconveniences the Applicant has studied, designed and developed the device described in this invention.

SUMMARY OF THE INVENTION

The device for lateral containment of liquid steel between two crystallizing rolls of a casting machine for a steel strip provides a connecting system between the trust unit and the confinement plates of the liquid bath which will ensure an excellent uniform pressure distribution on the surfaces on these plates in sliding contact with the rolls, allowing the plates to adapt well to lateral surfaces of the rolls in all working conditions.

Advantageously the invention provides a device to contain the liquid steel within the casting rolls, making it possible to optimize the contact conditions between the containing plates and the side faces of the corresponding rolls.

Advantageously, it is the maximum capacity of these plates is guaranteed to adapt to the side faces by using an oscillating connection between the plate thrust unit and the plates themselves.

In particular, this invention provides a uniform pressure distribution on the refractory skid in the whole contact area with the corresponding side surface of the roll so that in this area wear is uniform: the result is a longer use of this skid and a better prevention of melted metal losses. A longer refractory life leads to clear advantages in terms of cost and less stoppages of the casting machine for skid changing.

It is known from the state of the art that the casting rolls are cooled by internal water circulation and that the feeding zone for this cooling water has to be outside the part of the roll which is in contact with the solidifying strip in order to eliminate the thermal exchange transients and thus to guarantee uniform solidification along the generators that define this portion. In order to permit the introduction of the means able to contain the liquid steel bath up to the borders of the strip formation zone, it is necessary to reduce by a few millimeters the diameter of the end zones not in contact with the strip; in any case this difference in diameter is limited because the circumferential distribution of the cooling water must be as near as possible to the external surface of the roll. The lateral containment plates are therefore housed in the space created by the configuration of the casting rolls and rest on the shoulder or step resulting from the difference in diameter between the roll section in contact and the one not in contact with the liquid steel.

The so-called containment plate is made up of, with reference to only one side of the casting rolls, a refractory skid and a variety (three at least) of steel plates, spaced and connected by means of fixing elements, such as screws, welded pins or other.

The applicant has found that, in order to obtain the desired uniform distribution of the pressure on the refractory skid, it is possible to act on the arrangement of these fixing elements. More precisely, a staggered arrangement allows all the elements to be compressed by the thrusting force and, consequently, contact pressure distribution is more uniform.

Regarding the oscillating connection between the thrust unit and the plates, the applicant has conceived a ball joint with a particular manufacturing solution which allows the application point of the thrust force to be nearer to the contact surface between the plate and the roll side, thus minimizing the moment due to the friction on the refractory skid. For execution, a part of the ball has to be directly in contact with the adjacent metallic plate, thus eliminating the intermediate connection elements (pin and fork) typical of a traditional ball joint. This joint allows the casting skid to oscillate longitudinally and transversally to the casting roll, while the rotation of the skid itself on its own plane is hindered by an anti-rotation system.

BRIEF DESCRIPTION OF THE DRAWINGS

Further characteristics and advantages of this invention are contained in the following description of a preferred working procedure that is illustrative and non limiting, with the help of the attached drawings, where.

DETAILED DESCRIPTION OF PREFERRED EMBODIMENTS

Figure 1A:
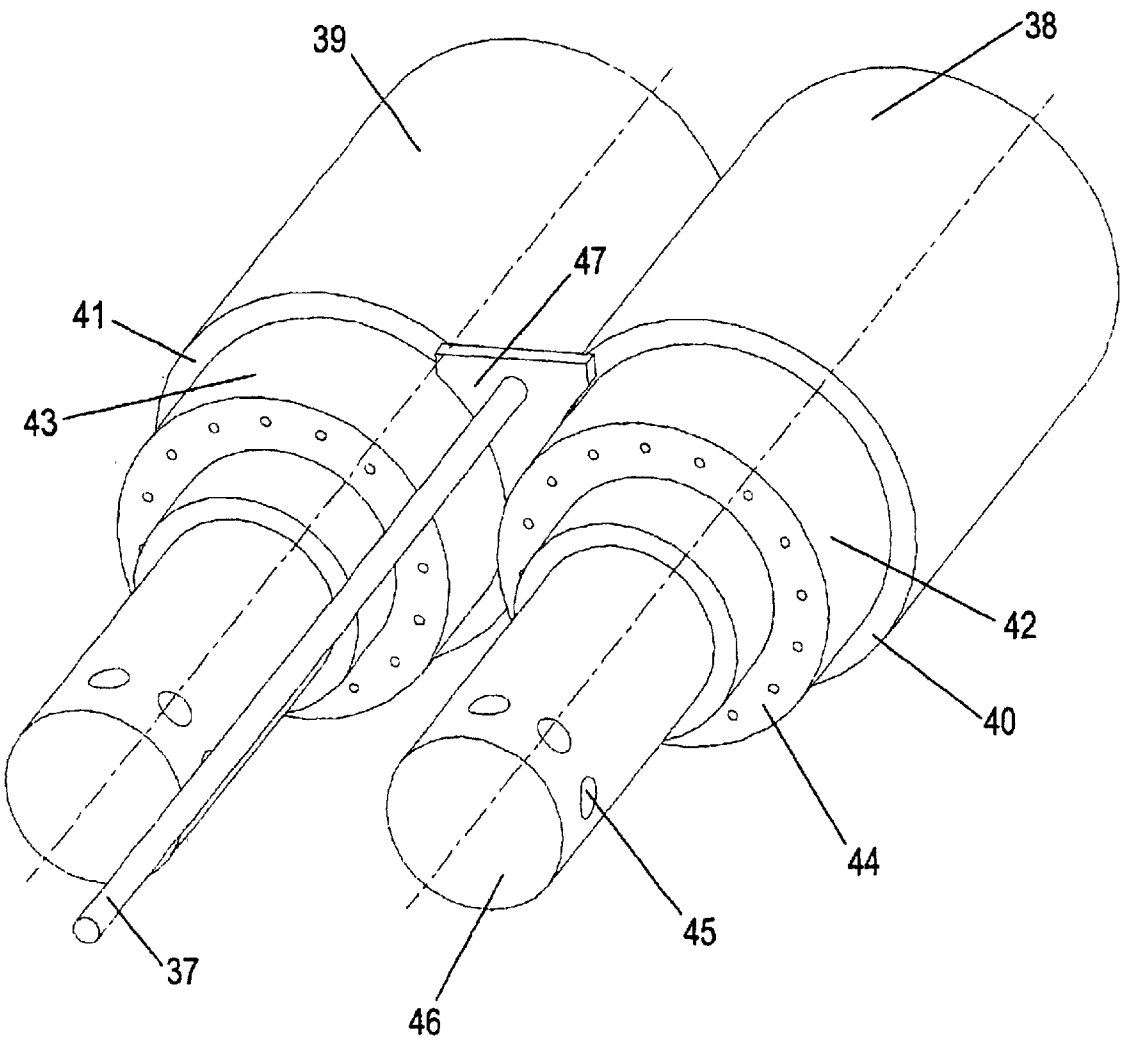
FIG. 1*a* is a prospective view of the crystallizing rolls, clearly illustrating the arrangement of the lateral containment system to which this invention refers.

In FIG. 1*a*, a shaft 46 of crystallizing rolls 38, 39 has radial openings 45 to feed cooling water, which, through internal non-illustrated passages, is brought to a flange 44 and from here distributed circumferentially on the peripheral of these rolls through special channels that extend internally, parallel to their axis. Sections 42, 43 of rolls 38, 39 are not involved in strip forming since they do not come into contact with the liquid steel; shoulders 40, 41 mark the beginning of the zone that is in contact with the liquid steel and the lateral confinement of the steel within this area is guaranteed by a plate 47. The cross size of this plate and therefore its surface extension is limited to the above described configuration of crystallizing rolls 38, 39 and depends on the height of shoulders 40, 41.

Figure 1B:
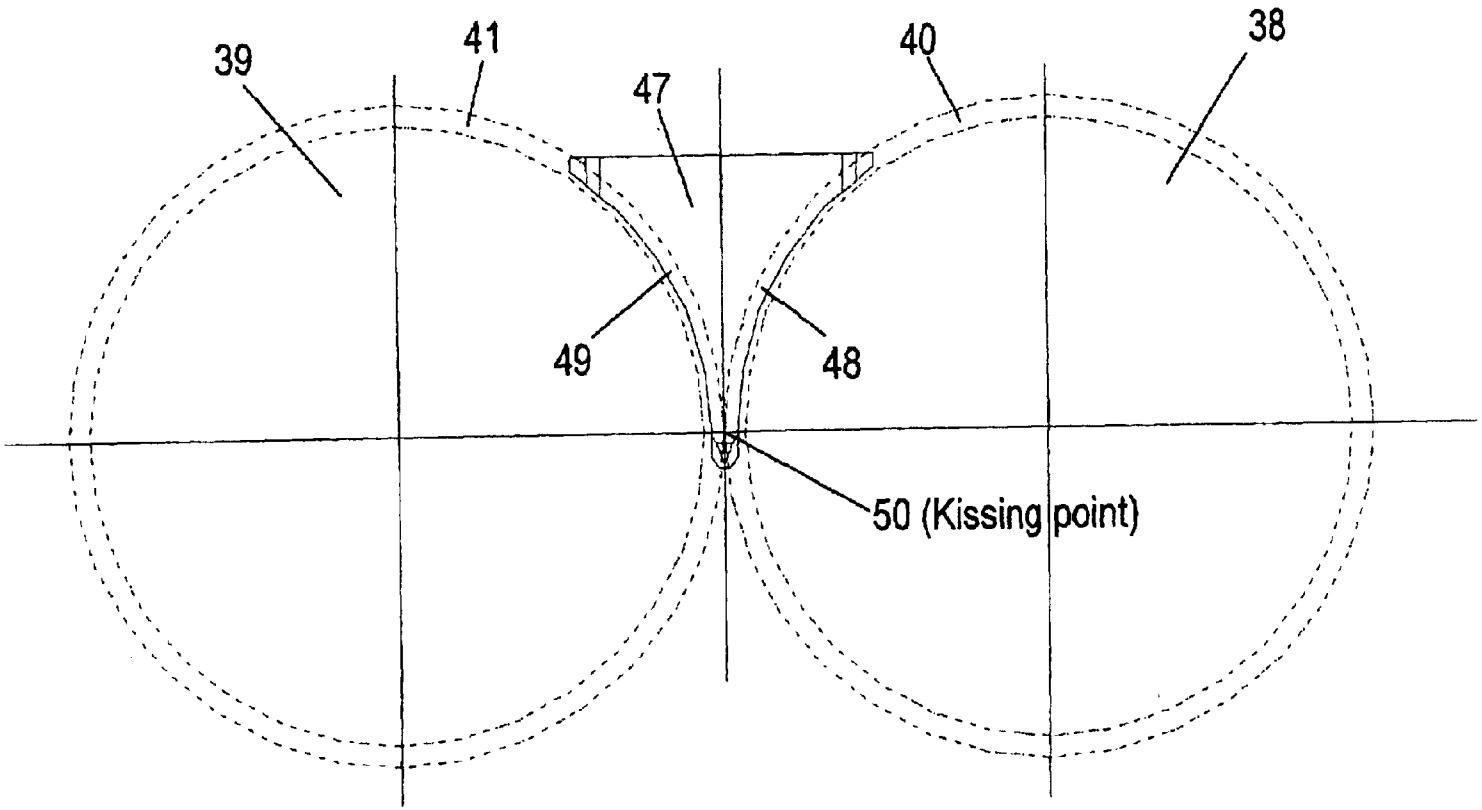
FIG. 1*b* is a cross section of the assembly in FIG. 1*a;*

FIG. 1*b* shows areas 48, 49 of plate 47 that are in sliding contact with the respective shoulders 40, 41 of crystallizing rolls 38, 39 and a minimum distance point 50 between rolls referred to as the "kissing point".

Figure 2A:
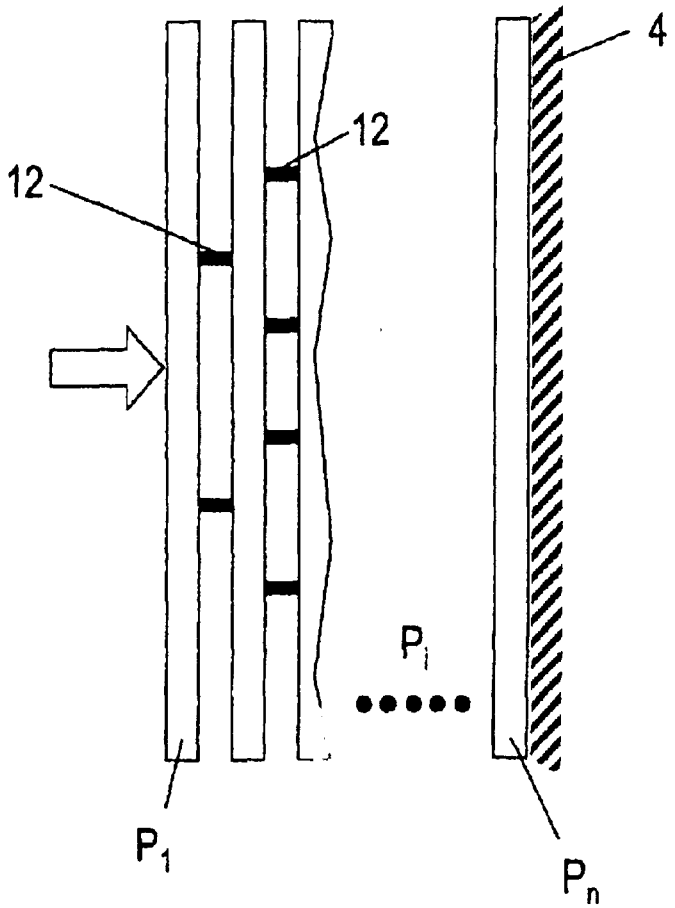
FIG. 2*a* is a two-dimensional diagram illustrating the staggered arrangement of the fixing elements of the steel plates of the device to which this invention refers.

As illustrated in FIG. 2*a*, the plate 47 is made up of a skid 4 in refractory material and number "n" of steel plates $P_1$, $P_2, \ldots P_i, P_{i+1}, P_{i+2}, \ldots, P_n$ spaced in such a way as to leave a suitable space for cooling with inert gas (argon or nitrogen) or, if this gas is not available, to guarantee low heat transfer. The plate $P_1$ is connected to a thrust unit 37, whereas plate $P_n$ supports the refractory skid 4. All plates are interconnected by means of fixing elements 12, which could be screws, welded pins or other.

The pressure on contact areas 48, 49 between refractory skid 4 and shoulders 40, 41 actually depends on the arrangement of the fixing elements 12. This concept is explained in FIG. 2*b* in a two-dimensional drawing and considering three plates 1, 2, 3. In solution A four fixing elements 12 are used in "aligned" arrangement, or on the same axis between plates 1, 2 and plates 2, 3; with this arrangement the fixing elements 12 are compressed but limit pressure to two peaks near refractory skid 4.

If a greater number of pressure peaks are required, it is possible to increase the number of fixing elements to six (Solution B) but this configuration means that the elements placed on the left end are not compressed but in traction, with subsequent zeroing of contact pressure between refractory skid 4 and the sides of the casting rolls near non-compressed elements 12.

Figure 2B:
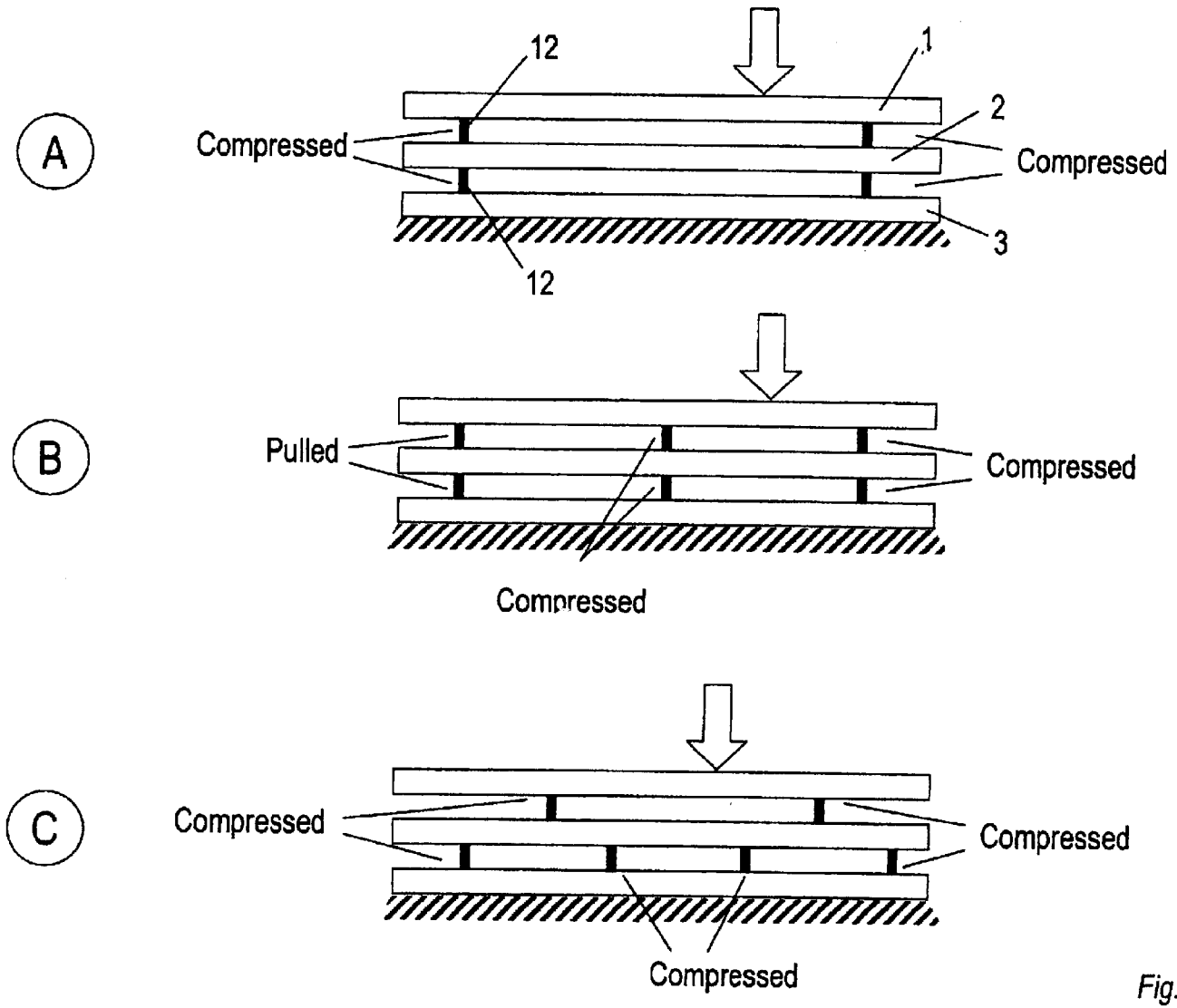
FIG. 2*b* is a two-dimensional diagram illustrating the arrangement of the fixing elements of the steel plates according to variants A, B, C.

In accordance with the invention, a staggered distribution of fixing elements 12, illustrated in solution C of FIG. 2*b*, guarantees the compression of all the elements and at the same time a better distribution of the contact pressure, as there are in fact four pressure peaks.

As for FIG. 2*a*, the concept expressed above can be generalized by affirming that each fixing element that connects plate $P_i$ to plate $P_{i+1}$ is provided with at least one pair of fixing elements to connect plate $P_{i+1}$ to plate $P_{i+2}$ and that, in reference to any side view of this device, the axis of the fixing elements that connect plate $P_i$ to plate $P_{i+1}$ assumes an intermediate position in the distance between the axes of the corresponding pair of fixing elements that connect plate $P_{i+1}$ to plate $P_{i+2}$, thereby resulting in fixing elements 12 with a basically staggered arrangement.

Figure 2C:
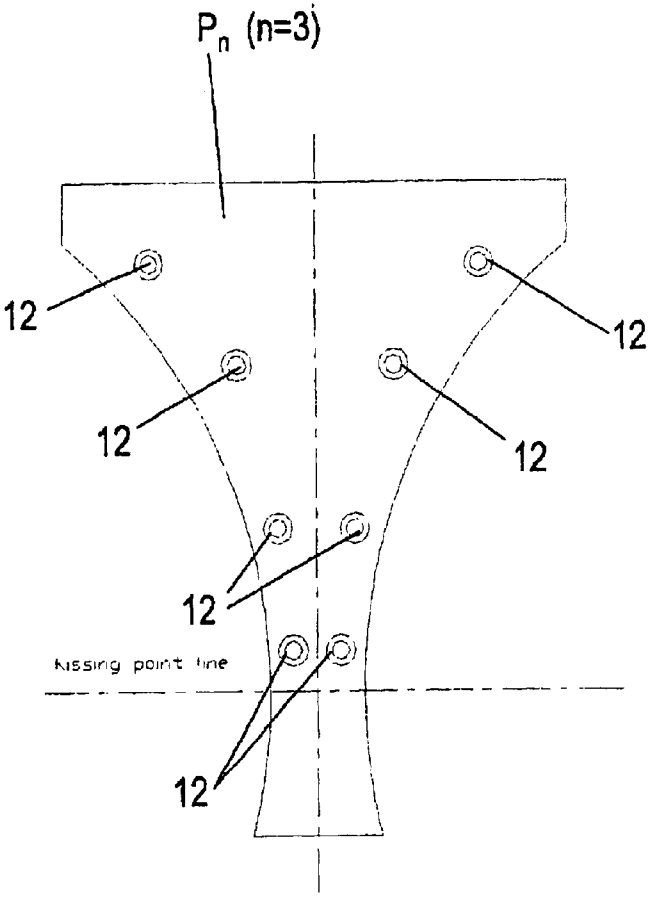
FIG. 2*c* shows two cross sections highlighting the arrangement of the plate fixing elements, according to the first embodiment.
Figure 2C:
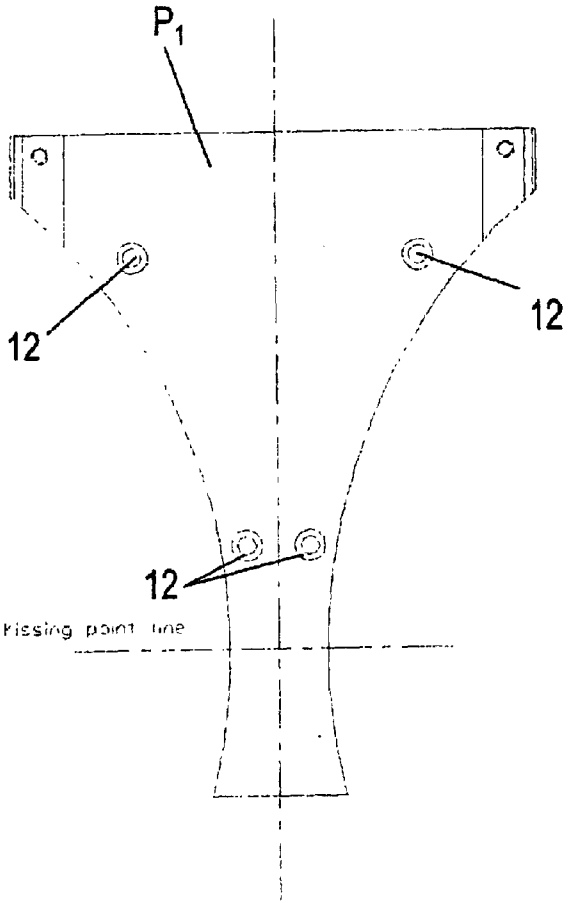
Figure 2D:
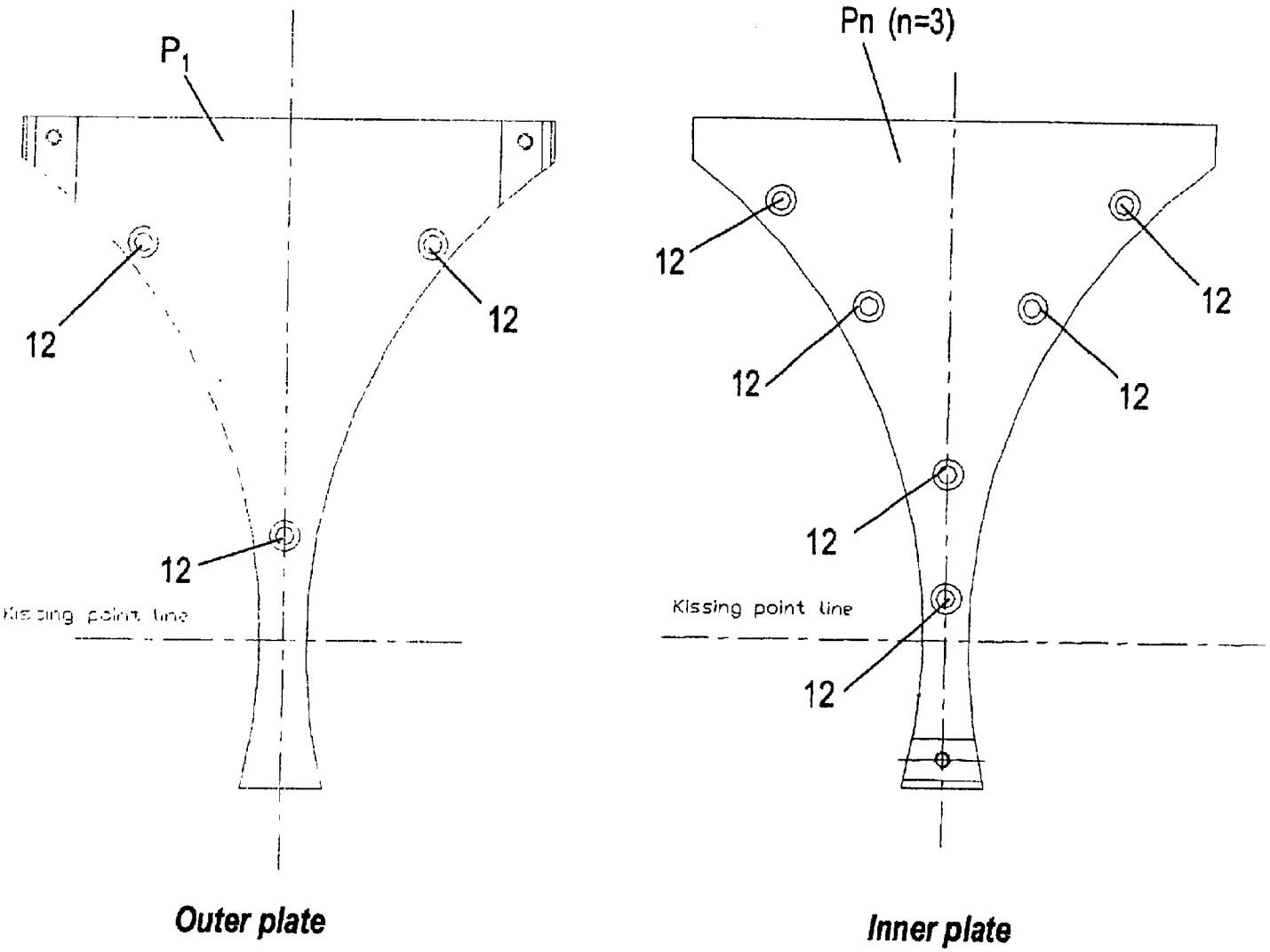
FIG. 2*d* shows two cross sections highlighting the arrangement of the plate fixing elements, according to the second embodiment.

FIGS. 2*c* and 2*d* illustrate a first and second embodiment, respectively, depending on the height of shoulders 40, 41.

As for FIG. 2*c*, or in the case where there is enough space to house the containment plates, there are four fixing elements that connect plate $P_1$ to plate $P_2$ and they are arranged specularly to the vertical axis of symmetry of plate $P_1$. If number n of plates is 3, then the fixing elements that connect intermediate plate $P_2$ to plate $P_n$ (with n=3) are, according to the above, 8 in number.

In the case of FIG. 2*d* plate $P_1$ is "narrower" at the bottom due to the reduced space; therefore the elements that fix plate $P_1$ to $P_2$ are down to 3 and, consequently, the elements that fix plate $P_2$ to $P_n$ (with n=3) become 6.

In general, by indicating with $V_{1,2}$ the number of fixing elements that connect plate $P_1$ to plate $P_2$, the number of fixing elements $V_{(i,i+1)}$ that connect plate $P_i$ to plate $P_{i+1}$ is $2^{(i-1)}*V_{1,2}$.

Figure 3:
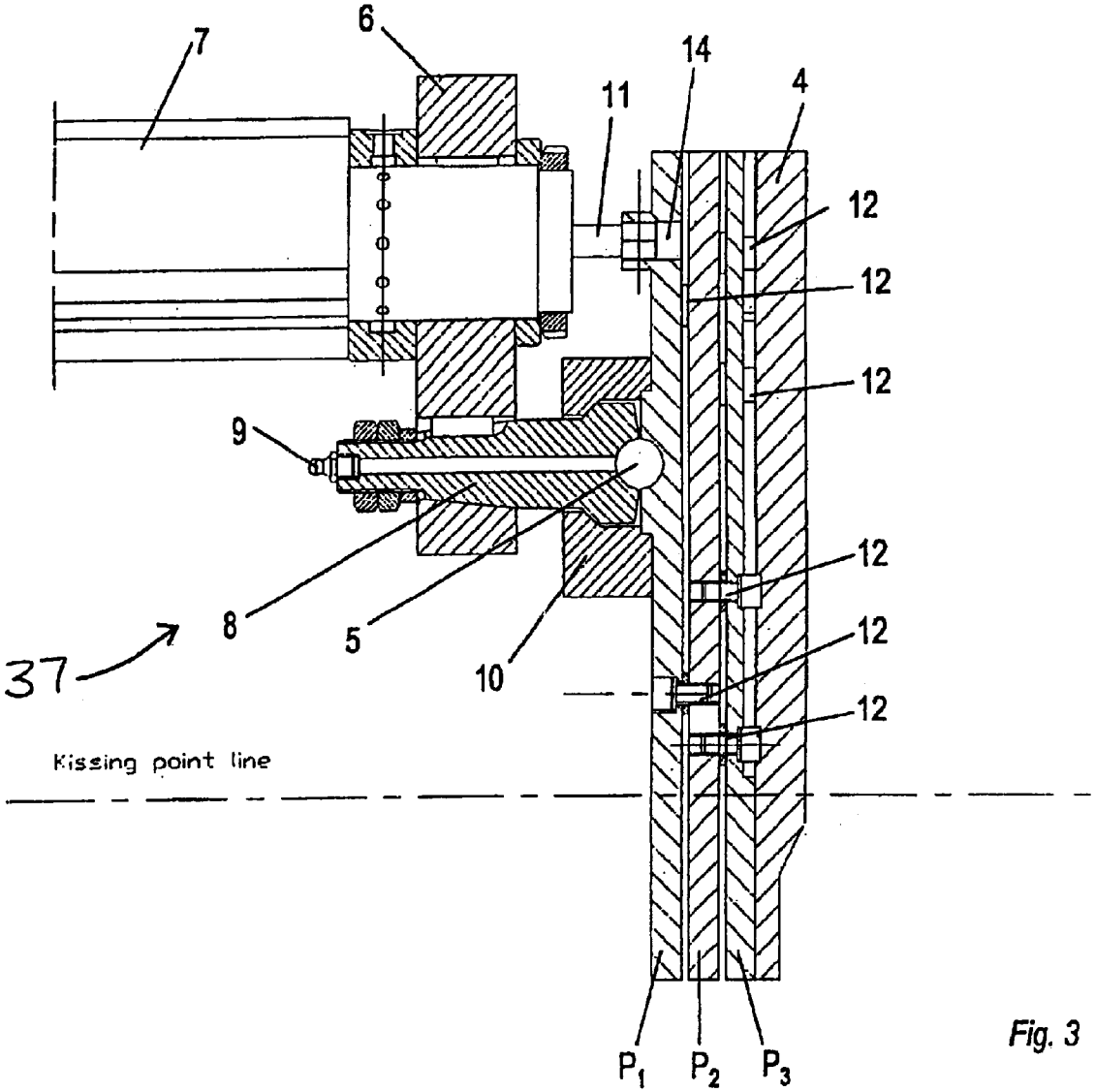
FIG. 3 is a longitudinal section of a lateral containment plate and the thrust unit.

In accordance with the embodiments of the invention, the oscillating connection between plate $P_1$ and thrust unit 37 is by means of a ball joint. With reference to FIG. 3, control rod 7 is connected to plate $P_1$ by means of bracket 6, connecting pin 8 and ball 5. With this configuration, the thrust force supplied through control rod 7 by a hydraulic piston, not illustrated here, is applied in correspondence of the ball 5. The ball joint is not a traditional type since it does not have the typical intermediate connecting elements (pin and fork). The seat of ball 5, in fact, is in the corresponding surfaces on connecting pin 8 and plate $P_1$, since connecting pin 8 and plate $P_1$ are connected to each other by means of fixing plaque 10. According to one embodiment, ball 5 can be made of a ceramic material.

Compared to a traditional ball joint, this manufacturing solution has various advantages: the overall dimensions can be reduced to a minimum and consequently the protection system against oxidation of the liquid bath can be simplified. It allows plate $P_1$ to be supported even when refractory skid 4 is not in contact with the side of the casting roll, it facilitates lubrication of ball 5, which is done through intake point 9, simplifies maintenance and speeds up replacement thanks to the bevel coupling of connecting pin 8 in bracket 6.

Another important advantage deriving from the use of this joint is that it moves the application point of the thrust force closer to the sliding surface between refractory skid and casting roll, thereby minimizing the moment applied by the resultant of the frictional force with respect to the center of ball 5.

This makes it possible to have the straight action line of the contact pressure resultant that is nearest to the straight action line of the thrust force.

Ball 5 allows maximum turning or oscillating freedom of plate $P_1$ and therefore maximum adaptation possibility of skid 4 on the side of the casting roll. To avoid dragging of refractory skid 4 caused by friction with the roll during rotation, it is necessary to adopt an anti-rotation system, which in this case is made up of stop 11 integral with control rod 7 that fits into a seat cut 14 into metal plate $P_1$. The configuration of stop 11 and corresponding seat of the anti-rotation system allows the plate to rotate longitudinally around the center of ball 5 and, furthermore, for any position assumed by the skid during longitudinal rotation, to rotate (transversally to the rolls) around the axis that passes through the center of ball 5 parallel to the new direction taken by plate $P_1$. Maximum allowable amplitude for both indicated rotations is ±2 degrees.

For reasons of symmetry, the stop 11 is effectively placed on the longitudinal axis passing through the center of ball 5.

Other examples of manufacturing solutions for the anti-rotation system are given in FIGS. 4*a*, 4*b*, 4*c*, 4*d*.

Figure 4A:
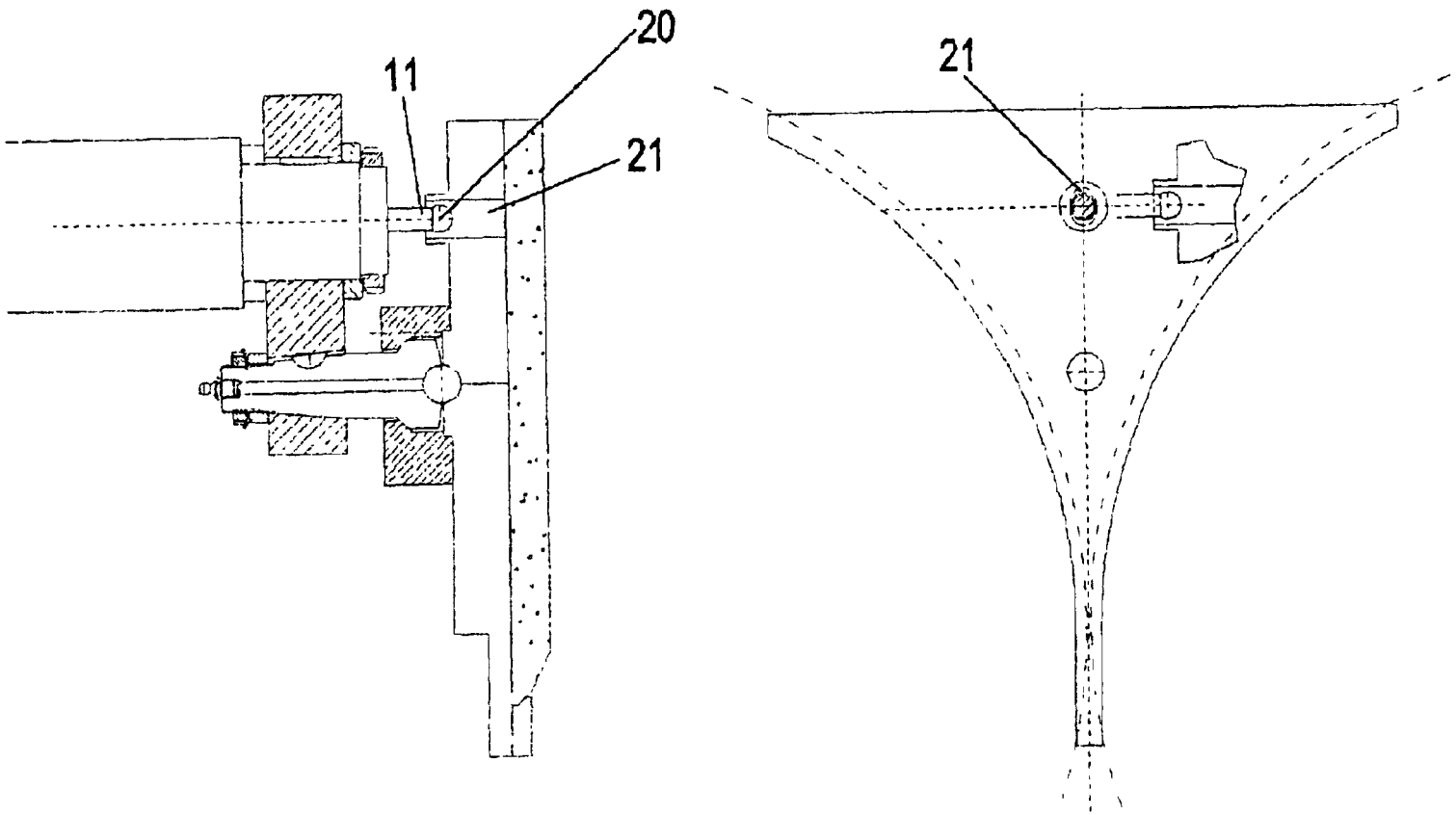
FIG. 4*a* is a cross section of the first variant of the anti-rotation system.

According to the first variant illustrated in FIG. 4*a*, the stop 11 has a spherical end 20 that fits into the corresponding slotted opening 21 cut into metal plate $P_1$.

Figure 4B:
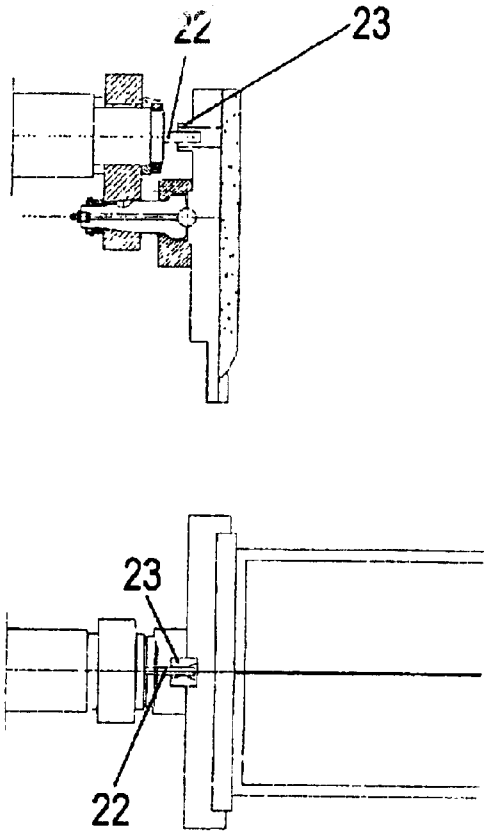
FIG. 4*b* is a cross section of the second variant of the anti-rotation system.

In accordance with a second variant illustrated in FIG. 4*b*, the stop is made up of a foil 22 that fits into a corresponding shaped groove 23 with convex profile cut into the plate $P_1$.

Figure 4C:
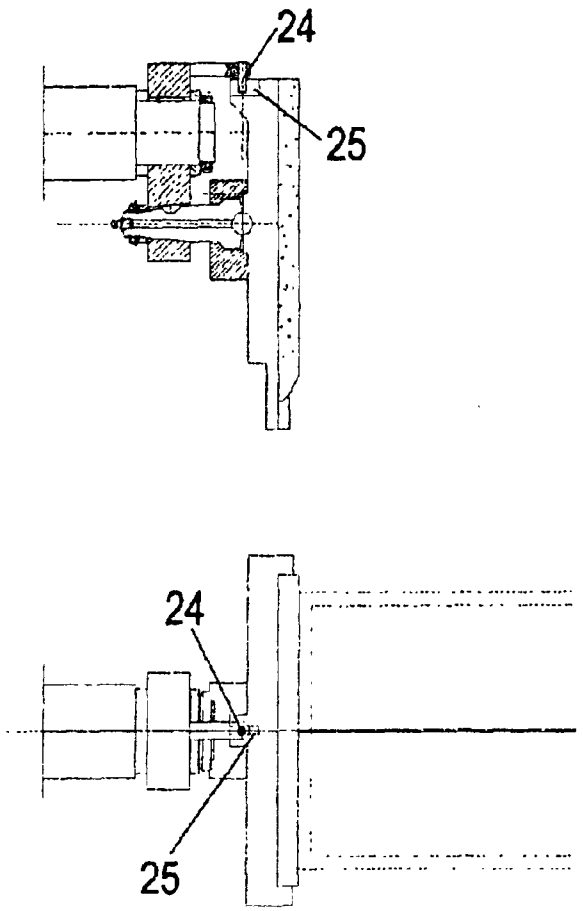
FIG. 4*c* is a cross section of the third variant of the anti-rotation system.

According to the third variant illustrated in FIG. 4*c*, the stop is made up of a pin 24 that fits into the corresponding groove 25 cut into the plate $P_1$.

Figure 4D:
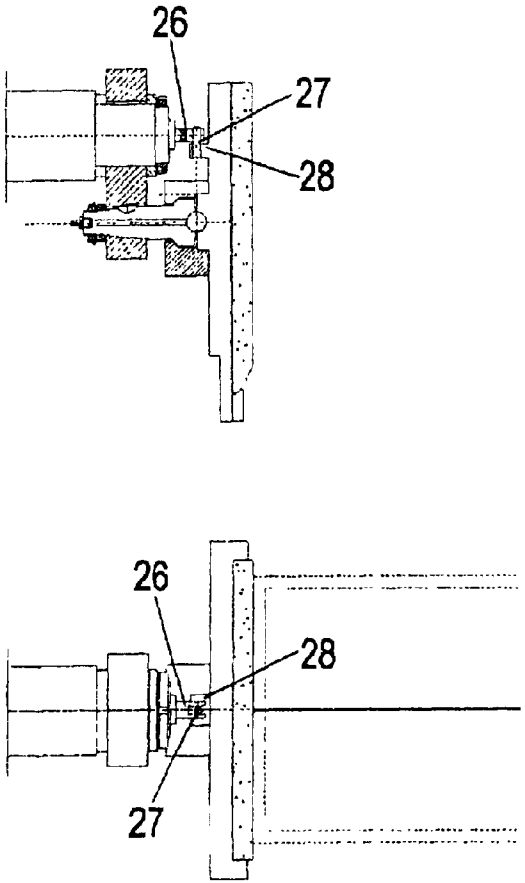
FIG. 4*d* is a cross section of the fourth variant of the anti-rotation system.

According to another variant illustrated in FIG. 4*d*, the stop is made up of a fork 26 that holds a pin 27, which fits into a special shaped projection 28 with convex profile cut into plate $P_1$.

It is clear that the device described above can be modified or parts can be added to it without leaving the scope of this invention.

It is also clear that, although this invention has been described with reference to specific examples, an expert in this field will undoubtedly be able to create many other types of similar devices, within the scope of invention.

What is claimed is:

1. Device for lateral containment of liquid steel between two crystallizing rolls of a casting machine for a steel strip, comprising a refractory skid and a thrust unit for the skid, wherein at least 3 spaced apart steel plates ($P_1 \ldots P_i$, $P_{i+1} \ldots P_n$) are successively arranged between the skid and the thrust unit and interconnected by means of fixing elements in a staggered apart arrangement.

2. Device according to claim 1, wherein each fixing element that connects plate ($P_i$) to the next plate ($P_{i+1}$) has associated thereto at least one pair of fixing elements connecting the next plate ($P_{i+1}$) to the following next plate ($P_{i+2}$).

3. Device according to claim 1, wherein the fixing elements that connect plate ($P_1$) to plate ($P_{i+1}$) comprise an axis, which is in an intermediate position of the distance between the axis of the corresponding pair of fixing elements that connect plate ($P_{i+1}$) to plate ($P_{i+2}$).

4. Device according to claim 3, wherein the number $V_{(i,i+1)}$ of fixing elements that connect plate ($P_i$) to plate ($P_{i+1}$) is $2^{(i-1)}.V_{1,2}$, where $V_{1,2}$ is the number of fixing elements that connect plate ($P_1$) to plate ($P_2$).

5. Device according to claim 4, wherein the number $V_{1,2}$ of fixing elements is 3.

6. Device according to claim 4, wherein the number $V_{1,2}$ of fixing elements is 4.

7. Device according to claim 1, wherein the thrust unit is connected through a ball to the plate ($P_1$), said ball being housed in corresponding spherical surfaces cut into a pin of the thrust unit and the plate ($P_1$), said unit and said plate ($P_1$) being connected by means of a fixing plaque.

8. Device according to claim 7, wherein the thrust unit comprises a control rod, a bracket, and the connecting pin.

9. Device according to claim 7, wherein the ball is made of ceramic material.

10. Device according to claim 9, comprising an anti-rotation system for the plate ($P_1$).

11. Device according to claim 10, wherein the anti-rotation system comprises a stop integral with the control rod that fits into a special seat cut into the plate ($P_1$).

12. Device according to claim 11, wherein the plate ($P_1$) is rotatable longitudinally around the center of the ball and, furthermore, regardless of the position of the skid in longitudinal rotation, transverse to the crystallizing rolls around an axis passing through the center of the ball and parallel to the new position of the plate ($P_1$).

13. Device according to claim 8, wherein said plate ($P_1$) is rotatable with a maximum amplitude of ±2 degrees.

14. Device according to claim 9, wherein said stop has a spherical end that fits into a slotted opening cut into the plate ($P_1$).

15. Device according to claim 9, wherein said stop comprises a foil that fits into a special shaped groove with a convex profile cut into the plate ($P_1$).

16. Device according to claim 9, wherein said stop comprises a pin that fits into a corresponding groove cut into the plate ($P_1$).

17. Device according to claim 9, wherein said stop comprises a fork that holds a pin which fits into a special shaped projection of the plate ($P_1$).

18. Device for lateral containment of liquid steel between two crystallizing rolls of a casting machine for a steel strip, comprising a refractory skid and a thrust unit for the skid, wherein at least 3 spaced apart steel plates ($P_1, \ldots P_I$, $P_{i+1}, \ldots P_n$) are successively arranged between the skid and the thrust unit and interconnected by means of fixing elements in a staggered apart arrangement, wherein each fixing element that connects plate ($P_i$) to the next plate ($P_{i+1}$) has associated thereto at least one pair of fixing elements connecting the next plate ($P_{i+1}$) to the following next plate ($P_{i+2}$).

19. Device for lateral containment of liquid steel between two crystallizing rolls of a casting machine for a steel strip, comprising a refractory skid and a thrust unit for the skid, wherein at least 3 spaced apart steel plates ($P_1, \ldots P_i$, $P_{i+1}, \ldots P_n$) are successively arranged between the skid and the thrust unit and interconnected by means of fixing elements in a staggered apart arrangement, wherein the fixing elements that connect plate ($P_i$) to plate ($P_{i+1}$) comprise an axis, which is in an intermediate position of the distance between the axis of the corresponding pair of fixing elements that connect plate ($P_{i+1}$) to plate ($P_{i+2}$).

20. Device for lateral containment of liquid steel between two crystallizing rolls of a casting machine for a steel strip, comprising a refractory skid and a thrust unit for the skid, wherein at least 3 spaced apart steel plates ($P_1, \ldots P_i$, $P_{i+1}, \ldots P_n$) are successively arranged between the skid and the thrust unit and interconnected by means of fixing elements in a staggered apart arrangement, wherein the fixing elements that connect plate ($P_i$) to plate ($P_{i+1}$) comprise an axis, which is in an intermediate position of the distance between the axis of the corresponding pair of fixing elements that connect plate ($P_{i+1}$) to plate ($P_{i+2}$), and wherein the number $V_{(i,i+1)}$ of fixing elements that connect plate ($P_i$) to plate ($P_{i+1}$) is $2^{(i-1)}*V_{1.2}$, where $V_{1,2}$ is the number of fixing elements that connect plate ($P_1$) to plate ($P_2$).

21. Device for lateral containment of liquid steel between two crystallizing rolls of a casting machine for a steel strip, comprising a refractory skid and a thrust unit for the skid, wherein at least 3 spaced apart steel plates ($P_1$, . . . $P_i$, $P_{i+1}$, . . . $P_n$) are successively arranged between the skid and the thrust unit and interconnected by means of fixing elements in a staggered apart arrangement, wherein the thrust unit is connected through a ball to the plate ($P_1$), said ball being housed in corresponding spherical surfaces cut into a pin of the thrust unit and the plate ($P_1$), said unit and said plate ($P_1$) being connected by means of a fixing plaque.

22. Device for lateral containment of liquid steel between two crystallizing rolls of a casting machine for a steel strip, comprising a refractory skid and a thrust unit for the skid, wherein at least 3 spaced apart steel plates ($P_1$, . . . $P_i$, $P_{i+1}$, . . . $P_n$) are successively arranged between the skid and the thrust unit and interconnected by means of fixing elements in a staggered apart arrangement, wherein the thrust unit is connected through a ball to the plate ($P_1$), said ball being housed in corresponding spherical surfaces cut into a pin of the thrust unit and the plate ($P_1$), said unit and said plate ($P_1$) being connected by means of a fixing plaque, and wherein the thrust unit comprises a control rod, a bracket, and the connecting pin.

23. Device for lateral containment of liquid steel between two crystallizing rolls of a casting machine for a steel strip, comprising a refractory skid and a thrust unit for the skid, wherein at least 3 spaced apart steel plates ($P_1$, . . . $P_i$, $P_{i+1}$, . . . $P_n$) are successively arranged between the skid and the thrust unit and interconnected by means of fixing elements in a staggered apart arrangement, wherein the thrust unit is connected through a ball to the plate ($P_1$), said ball being housed in corresponding spherical surfaces cut into a pin of the thrust unit and the plate ($P_1$), said unit and said plate ($P_1$) being connected by means of a fixing plaque, and wherein the ball is made of ceramic material.

24. Device for lateral containment of liquid steel between two crystallizing rolls of a casting machine for a steel strip, comprising a refractory skid and a thrust unit for the skid, wherein at least 3 spaced apart steel plates ($P_1$, . . . $P_i$, $P_{i+1}$, . . . $P_n$) are successively arranged between the skid and the thrust unit and interconnected by means of fixing elements in a staggered apart arrangement, wherein the thrust unit is connected through a ball to the plate ($P_1$), said ball being housed in corresponding spherical surfaces cut into a pin of the thrust unit and the plate ($P_1$), said unit and said plate ($P_1$) being connected by means of a fixing plaque, wherein the ball is made of ceramic material, and comprising an anti-rotation system for the plate ($P_1$).

25. Device for lateral containment of liquid steel between two crystallizing rolls of a casting machine for a steel strip, comprising a refractory skid and a thrust unit for the skid, wherein at least 3 spaced apart steel plates ($P_1$, . . . $P_i$, $P_{i+1}$, . . . $P_n$) are successively arranged between the skid and the thrust unit and interconnected by means of fixing elements in a staggered apart arrangement, wherein the thrust unit is connected through a ball to the plate ($P_1$), said ball being housed in corresponding spherical surfaces cut into a pin of the thrust unit and the plate ($P_1$), said unit and said plate ($P_1$) being connected by means of a fixing plaque, wherein the ball is made of ceramic material, and comprising an anti-rotation system for the plate ($P_1$), wherein the anti-rotation system comprises a stop integral with the control rod that fits into a special seat cut into the plate.

26. Device for lateral containment of liquid steel between two crystallizing rolls of a casting machine for a steel strip, comprising a refractory skid and a thrust unit for the skid, wherein at least 3 spaced apart steel plates ($P_1$, . . . $P_i$, $P_{i+1}$, . . . $P_n$) are successively arranged between the skid and the thrust unit and interconnected by means of fixing elements in a staggered apart arrangement, wherein the thrust unit is connected through a ball to the plate ($P_1$), said ball being housed in corresponding spherical surfaces cut into a pin of the thrust unit and the plate ($P_1$), said unit and said plate ($P_1$) being connected by means of a fixing plaque, wherein the ball is made of ceramic material, comprising an anti-rotation system for the plate ($P_1$), wherein the anti-rotation system comprises a stop integral with the control rod that fits into a special seat cut into the plate, and wherein the plate ($P_1$) is rotatable longitudinally around the center of the ball and, furthermore, regardless of the position of the skid in longitudinal rotation, transverse to the crystallizing rolls around an axis passing through the center of the ball and parallel to the new position of the plate ($P_1$).

27. Device for lateral containment of liquid steel between two crystallizing rolls of a casting machine for a steel strip, comprising a refractory skid and a thrust unit for the skid, wherein at least 3 spaced apart steel plates ($P_1$, . . . $P_i$, $P_{i+1}$, . . . $P_n$) are successively arranged between the skid and the thrust unit and interconnected by means of fixing elements in a staggered apart arrangement, wherein the thrust unit is connected through a ball to the plate ($P_1$), said ball being housed in corresponding spherical surfaces cut into a pin of the thrust unit and the plate ($P_1$), said unit and said plate ($P_1$) being connected by means of a fixing plaque, wherein the thrust unit comprises a control rod, a bracket, and the connecting pin, and wherein said plate ($P_1$) is rotatable with a maximum amplitude of ±2 degrees.

28. Device for lateral containment of liquid steel between two crystallizing rolls of a casting machine for a steel strip, comprising a refractory skid and a thrust unit for the skid, wherein at least 3 spaced apart steel plates ($P_1$, . . . $P_i$, $P_{i+1}$, . . . $P_n$) are successively arranged between the skid and the thrust unit and interconnected by means of fixing elements in a staggered apart arrangement, wherein the thrust unit is connected through a ball to the plate ($P_1$), said ball being housed in corresponding spherical surfaces cut into a pin of the thrust unit and the plate ($P_1$), said unit and said plate ($P_1$) being connected by means of a fixing plaque, wherein the ball is made of ceramic material, and wherein said stop has a spherical end that fits into a slotted opening cut into the plate ($P_1$).

29. Device for lateral containment of liquid steel between two crystallizing rolls of a casting machine for a steel strip, comprising a refractory skid and a thrust unit for the skid, wherein at least 3 spaced apart steel plates ($P_1$, . . . $P_i$, $P_{i+1}$, . . . $P_n$) are successively arranged between the skid and the thrust unit and interconnected by means of fixing elements in a staggered apart arrangement, wherein the thrust unit is connected through a ball to the plate ($P_1$), said ball being housed in corresponding spherical surfaces cut into a pin of the thrust unit and the plate ($P_1$), said unit and said plate ($P_1$) being connected by means of a fixing plaque, wherein the ball is made of ceramic material, and wherein said stop comprises a foil that fits into a special shaped groove with a convex profile cut into the plate ($P_1$).

30. Device for lateral containment of liquid steel between two crystallizing rolls of a casting machine for a steel strip, comprising a refractory skid and a thrust unit for the skid, wherein at least 3 spaced apart steel plates ($P_1$, . . . $P_i$, $P_{i+1}$, . . . $P_n$) are successively arranged between the skid and the thrust unit and interconnected by means of fixing elements in a staggered apart arrangement, wherein the thrust unit is connected through a ball to the plate ($P_1$), said ball being housed in corresponding spherical surfaces cut into a pin of the thrust unit and the plate ($P_1$), said unit and said plate ($P_1$) being connected by means of a fixing plaque, wherein the ball is made of ceramic material, and wherein said stop comprises a pin that fits into a corresponding groove cut into the plate ($P_1$).

31. Device for lateral containment of liquid steel between two crystallizing rolls of a casting machine for a steel strip, comprising a refractory skid and a thrust unit for the skid, wherein at least 3 spaced apart steel plates ($P_1$, . . . $P_i$, $P_{i+1}$, . . . $P_n$) are successively arranged between the skid and the thrust unit and interconnected by means of fixing elements in a staggered apart arrangement, wherein the thrust unit is connected through a ball to the plate ($P_1$), said ball being housed in corresponding spherical surfaces cut into a pin of the thrust unit and the plate ($P_1$), said unit and said plate ($P_1$) being connected by means of a fixing plaque, wherein the ball is made of ceramic material, and wherein said stop comprises a fork that holds a pin which fits into a special shaped projection of the plate ($P_1$).

* * * * *